US010342353B2

(12) United States Patent
Chen

(10) Patent No.: US 10,342,353 B2
(45) Date of Patent: Jul. 9, 2019

(54) CHAIR RECLINING ADJUSTMENT MECHANISM

(71) Applicant: ZHONGWEI HOLDING GROUP CO., LTD, Wenzhou (CN)

(72) Inventor: Qiankui Chen, Wenzhou (CN)

(73) Assignee: ZHONGWEI HOLDING GROUP CO., LTD, Wenzhou (CN)

( * ) Notice: Subject to any disclaimer, the term of this patent is extended or adjusted under 35 U.S.C. 154(b) by 137 days.

(21) Appl. No.: 15/654,757

(22) Filed: Jul. 20, 2017

(65) Prior Publication Data

US 2018/0360221 A1 Dec. 20, 2018

(30) Foreign Application Priority Data

Jun. 20, 2017 (CN) ..... 2017 1 0471463
Jun. 20, 2017 (CN) ..... 2017 2 0723151 U

(51) Int. Cl.
*A47C 7/40* (2006.01)
*A47C 1/02* (2006.01)
*A47C 1/031* (2006.01)

(52) U.S. Cl.
CPC ..... *A47C 7/40* (2013.01); *A47C 1/02* (2013.01); *A47C 1/031* (2013.01)

(58) Field of Classification Search
CPC .... A47C 7/40; A47C 7/34; A47C 1/02; A47C 1/031; A47C 1/032; A47C 1/034; A47C 1/036; A47C 3/22; A47C 3/24; A47C 3/245; A47C 3/28; A47C 3/40
USPC ..... 297/270.1
See application file for complete search history.

(56) References Cited

U.S. PATENT DOCUMENTS 5,080,434 A * 1/1992 Locher ..... A47C 1/03216 297/300.3
6,120,096 A * 9/2000 Miotto ..... A47C 1/03255 297/300.1
6,213,552 B1 * 4/2001 Miotto ..... A47C 1/03238 297/300.5
6,231,126 B1 * 5/2001 Cheng ..... A47C 3/00 297/326
6,352,308 B1 * 3/2002 Chen ..... A47C 3/18 248/188.1

(Continued)

FOREIGN PATENT DOCUMENTS

CN 2922618 Y 7/2007
CN 102090805 A 6/2011

*Primary Examiner* — Mark R Wendell
(74) *Attorney, Agent, or Firm* — Mark M. Friedman

(57) ABSTRACT

The present invention discloses a chair reclining adjustment mechanism, including a chassis, a turntable rotatably connected to the chassis by using a rotation shaft, and an elastic resetting device that is disposed between the chassis and the turntable and is configured to always enable the turntable to have a moving trend of rotating towards one side of the rotation shaft, wherein a rotation gap is provided between the turntable and the chassis at the other side of the rotation shaft; the adjustment mechanism further includes a locking member capable of entering or slipping out of the rotation gap, a locking component that always enables the locking member to have a moving trend of entering the rotation gap and an unlocking component configured to pull the locking member to slip out of the rotation gap.

8 Claims, 10 Drawing Sheets

(56) References Cited

U.S. PATENT DOCUMENTS

| | | | | |
|---|---|---|---|---|
| 6,588,843 | B1 * | 7/2003 | Ebenstein | A47C 1/03238 297/300.1 |
| 6,598,936 | B1 * | 7/2003 | Klein | A47C 1/026 297/300.4 |
| 7,293,832 | B2 * | 11/2007 | Huang | A47C 1/03238 297/300.7 |
| 8,172,324 | B2 * | 5/2012 | Golynsky | A47C 1/03266 297/300.2 |
| 2002/0163242 | A1 * | 11/2002 | Beggs | A47C 1/026 297/463.1 |
| 2006/0022508 | A1 * | 2/2006 | Lin | A47C 1/02 297/463.2 |
| 2014/0239687 | A1 * | 8/2014 | Hazzard | A47C 1/02 297/311 |
| 2016/0174720 | A1 * | 6/2016 | Sander | A47C 7/441 297/303.4 |

* cited by examiner

CHAIR RECLINING ADJUSTMENT MECHANISM

TECHNICAL FIELD

The present invention relates to a chair, and in particular, to a chair reclining adjustment mechanism.

BACKGROUND ART

For example, the existing patents such as patents with grant publication No. CN2922618 and No. CN102090805A disclose a reclining chair chassis; a chair made by such a chassis can recline during the use process, so that a person sitting on the chair feels more comfortable.

The Chinese patent with the granted publication No. CN2922618 and the filing date Jul. 17, 2006 discloses a lifting and reclining chair chassis, formed by an upper disc, a middle disc, and a knob. The knob is fixed on the upper disc by using a carriage bolt; a dust cover, a washer, and a spring are mounted on the middle disc, and U-shaped iron is disposed on the middle disc; a U-shaped support frame is connected to a back steel plate base and the upper disc; the back steel plate base is connected to the middle disc by using a rivet, and the U-shaped support frame is connected to the back steel plate base by using the rivet. A lifting pump is disposed on the middle disc. A lifting control switch is mounted on one side of the upper disc of the chair, and the upper disc is connected to the middle disc by using a rivet and a bearing. When the chair reclines, the spring performs a resetting function for reclining of the chair, and a resetting acting force of the spring on the reclining of the chair can be adjusted by adjusting an elastic acting force of the spring.

The Chinese patent with the granted publication No. CN102090805A and the filing date Dec. 10, 2009 discloses a chair chassis with adjustable reclining force, including a middle disc and a large disc. The rear part of the large disc can swing around a rotation shaft downward relative to the middle disc, and a knob disposed below a front part of the middle disc is provided with a cavity, a mounting plate fixed with the knob is disposed in the cavity of the knob; a worm wheel is disposed at a position, corresponding to the lower part of the mounting plate, of the knob, and the worm wheel can rotate around the axis of the worm wheel relative to the knob; a worm engaged with the worm wheel is disposed beside the worm wheel in the knob; one end of a handle extends into the knob from the outside of the knob and is in transmission connection with the worm; an adjustment bolt is in threaded connection with the worm wheel after passing through the large disc, the middle disc, and the mounting plate in the knob from top to bottom in sequence; the adjustment bolt is coaxial with the worm wheel, and a spiral spring is sleeved at a position, below the middle disc and above the mounting plate, of the adjustment bolt. By means of the transmission connection between the handle and the worm, handle rotation can drive worm transmission, and the worm drives rotation of the worm wheel; the worm wheel moves upwards or downwards along an axial direction of the adjustment bolt, so that the mounting plate mounted and fixed with the knob moves upwards or downwards to adjust a compression degree of the spiral spring, thereby implementing the objective of adjusting the reclining force of the spiral spring on the chair, during operation, a user only needs to stretch his hand to one side of the chair to hold the handle for rotation without bending over.

The foregoing two patents disclose two structures for adjusting resetting acting force, so that the magnitude of the resetting acting force can be adjusted when a person sits on a chair made of such a chassis, and therefor the chair can be adapted to use requirements of various populations. However, currently, there is no chair of which a chassis can select whether to have a reclining function according to a requirement of a user.

SUMMARY OF THE INVENTION

The present invention is aimed at providing a chair reclining adjustment mechanism, which has the effect of freely selecting whether to have a reclining function.

The foregoing objective of the present invention is implemented by using the following technical solutions:

A chair reclining adjustment mechanism includes a chassis, a turntable rotatably connected to the chassis by using a rotation shaft, and an elastic resetting device that is disposed between the chassis and the turntable and is configured to always enable the turntable to have a moving trend of rotating towards one side of the rotation shaft, wherein a rotation gap is provided between the turntable and the chassis at the other side of the rotation shaft; the adjustment mechanism further includes a locking member capable of entering or slipping out of the rotation gap, a locking component that always enables the locking member to have a moving trend of entering the rotation gap, and an unlocking component configured to pull the locking member to slip out of the rotation gap.

By means of such configuration, a mutually-rotatable structure is formed between the chassis and the turntable connected by using the rotation shaft, and then the rotation gap is formed under the effect of the elastic force of the elastic resetting device; in this way, if a person sitting on the chair reclines backwards or forwards, the turntable accordingly rotates around the rotation shaft to drive the chair to rotate, so that the chair has a certain reclining capability. In addition, movement of the locking member is controlled by using the locking component and the unlocking component, so that the locking member can be clamped, by using the locking component, into the rotation gap to limit rotation of the turntable, and therefore a chair does not have a reclining effect; the locking member is pulled out of the rotation gap by using the unlocking component, so that the chair has a reclining effect.

Further preferably, the unlocking component includes a pull string one end of which is connected to the locking member, and a retractor configured to take up the pull string to overcome an elastic force.

By means of such configuration, when a reclining function is not needed, the retractor is rotated to wind the pull string thereon, to shorten a length of the pull string between the retractor and the locking member, so as to overcome the moving tread of the locking component to drive the locking member to perform corresponding displacement, thereby pulling the locking member out of the rotation gap; When a reclining function is not needed, the retractor is rotated in an opposite direction, and the pull string is loosened, so that the resetting spring resets the locking member under the effect of an elastic force, to re-clamp the locking member into the rotation gap.

Further preferably, the locking component includes a resetting spring of which an elastic force is opposite to a pulling force of the pull string, and an abutting plate against which the resetting spring abuts to generate an elastic force.

By means of such configuration, by disposing the abutting plate, the resetting spring is located between the locking member and the abutting plate, and when the pull string is pulled to unlock, the resetting spring forms compression, and therefore, when the pull string becomes longer again, the pull string resets under the elastic force of the resetting spring, so that the locking member enters the rotation gap to limit the turntable.

Further preferably, the locking member is a slide block connected to the turntable in a sliding and moving manner, and the elastic force of the resetting spring acts on the slide block.

By means of such configuration, the slide block is pulled by the pull string to slide and move on the turntable, so that the slide block is pulled out of the rotation gap and the limitation on the turntable is removed, and the turntable is enabled to rotate; under the effect of the resetting spring, the locking member is reset to be clamped in the rotation gap, to limit the turntable.

Further preferably, the locking member includes a rotation member rotatably connected to the turntable, a gear fixedly disposed on the rotation member, and a rack engaged with the gear and connected to the pull string, where an elastic force of the resetting spring acts on the rack.

By means of such configuration, the rack is pulled by the pull string to overcome the elastic force to perform sliding and moving movement, and then the rotation member is enabled to rotate by driving the gear to rotate, so that the rotation member rotates into the rotation gap or rotates out of the rotation gap, and after the pull string is loosened, it is reset under the effect of the elastic force of the resetting spring.

Further preferably, each of two ends of the pull string is provided with a clamping member; the locking member and the retractor are respectively provided with a clamping slot for embedding the clamping member, and an accommodating groove configured to accommodate the pull string.

By means of such configuration, connection between the pull string and the locking member and the retractor is implemented by means of a clamping bead and a clamping slot. The structure is simple, and the connection is convenient.

Further preferably, a hollow protection pipe is disposed between the abutting plate and the retractor, and the pull string is inserted into the hollow protection pipe.

By means of such configuration, the pull string is protected by using the hollow protection pipe, to reduce problems such as fracture of the pull string due to external reasons, thereby improving the service life thereof.

Further preferably, the retractor includes a housing, a take-up cylinder rotatably connected in the housing, and a limiting clamping member that is disposed on the housing and is configured to position the take-up cylinder; the clamping slot and the accommodating groove are disposed on the take-up cylinder, and a toggle piece that penetrates through the housing to be connected to the take-up cylinder is disposed outside the housing.

By means of such configuration, the take-up cylinder is rotated by using the toggle piece to take up the pull string, so as to overcome the elastic force of the resetting spring to pull the locking member; when the take-up cylinder rotates by a certain angle (when the locking member is clamped between the chassis and the turntable or the locking member slips out of the middle between the chassis and the turntable), the take-up cylinder is fixed by using the limiting clamping member to keep a locking member state.

Further preferably, the limiting clamping member is an elastic clamping piece that bends to form an clamping protrusion, and a plurality of recessed portions matched with the clamping protrusion are disposed on the take-up cylinder.

By means of such configuration, an elastic clamping piece is used as a limiting member to match and engage with the recessed portions on the take-up cylinder, to perform peripheral limiting fixation on the take-up cylinder, so that the length state of the pull string is maintained after the take-up cylinder is rotated to adjust the length of the pull string.

Further preferably, the elastic resetting device includes a pull rod connected to the chassis and the turntable, a compression spring sleeved on the pull rod, a pressing member that presses the compression spring on the chassis and a driving member that controls the pressing member to move along an axial direction of the pull rod, and the driving member is a knob or a worm and gear mechanism.

By means of such configuration, the pull rod penetrates through the turntable and the chassis to connect them, and then a compression spring is sleeved, and is maintained in a compressed state by using the pressing member, so that the elastic force of the compression spring acts on the chassis to keep the chassis and the turntable are pressed tight together to maintain the turntable located at an initial position; in addition, an elastic force on the compression spring is adjusted by using the driving member.

Based on the above, the present invention has the following beneficial effects: the turntable is rotatably connected to the chassis, and under the effect of the elastic resetting device, a person can recline backwards/forwards when sitting on a chair made of the components, so as to drive a chair seat fixed on the turntable to accordingly rotate, and therefore the person sitting on the chair feels more comfortable; in addition, the elastic force of the compression spring is adjusted by using the driving member to control the magnitude of the acting force needed to drive the turntable to rotate, and the force can be accordingly adjusted according to requirements of different weights and populations; in addition, by limiting the turntable by means of configuration of the locking member, whether the chair has a reclining function can be selected according to requirements, and an unlocking component is also used, which is disposed at a position convenient for operation, so as to facilitate adjustment and control by the person sitting on the chair.

In the figures, 1, turntable; 11, side wall; 12, connection hole; 13, counterbore; 14, arc-shaped protrusion; 2, chassis; 21, boss; 22, side plate; 23, escape hole; 3, rotation shaft; 4, elastic resetting device; 41, pull rod; 411, blocking cap; 412, limiting block; 42, compression spring; 43, corrugated sheath; 44, pressing member; 441, connection wall; 45, driving member; 451, worm; 452, worm wheel; 461, joystick; 5, lifting pump; 6, locking component; 61, connection block; 611, sliding groove; 62, abutting plate; 621, limiting protrusion; 63, resetting spring; 7, locking member; 71, slide block; 72, rotation member, 73, gear; 74, rack; 75, jack; 8, unlocking component; 81, pull string; 82, clamping member; 83, retractor; 831, housing; 8311, opening; 832, take-up cylinder, 8321, toggle piece; 8322, insertion hole; 8323, recessed portion; 8324, arc-shaped baffle; 833, limiting clamping member; 8331, clamping protrusion; 84, clamping slot; 85, accommodating groove; 9, hollow protection pipe; 10, rotation gap.

DETAILED DESCRIPTION OF THE INVENTION

The present invention is further described below with reference to the accompanying drawings.

Figure 1:
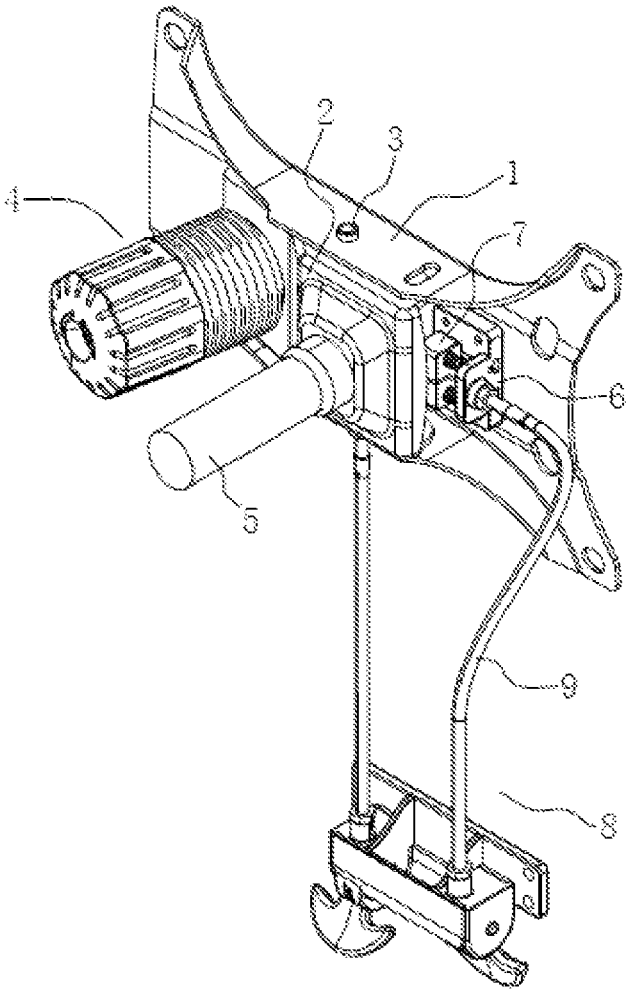
FIG. 1 is an overall schematic structural diagram of Embodiment 1.
Figure 4:
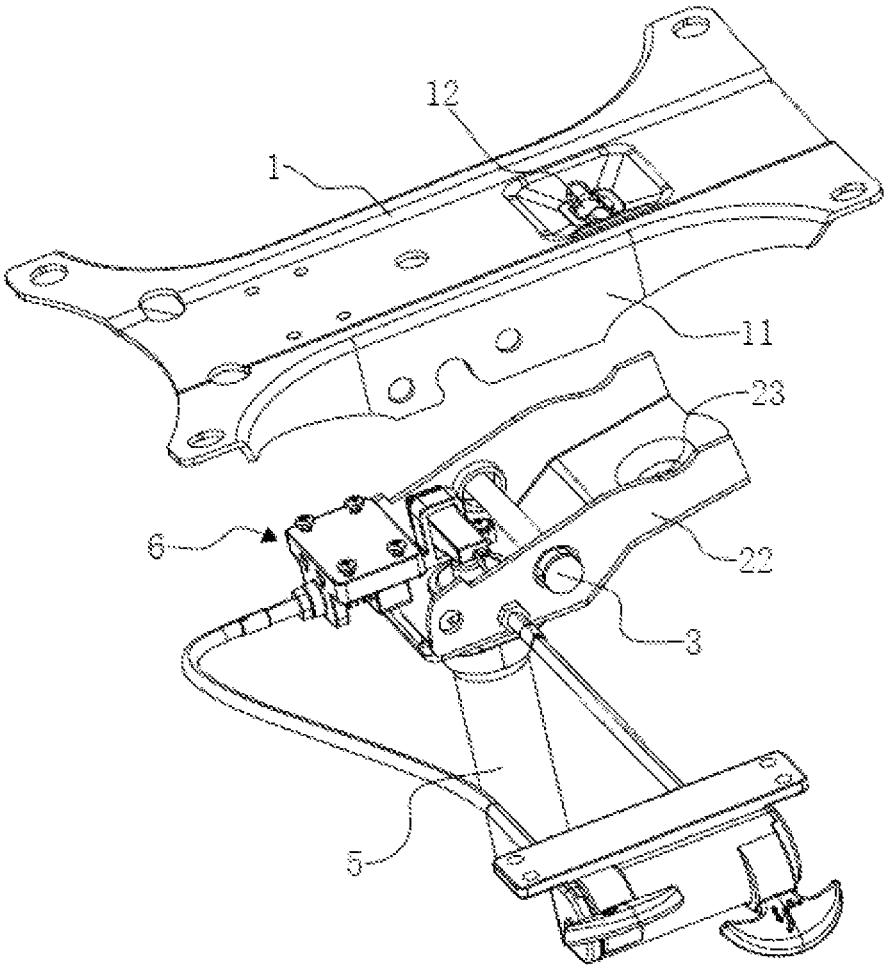
FIG. 4 is a schematic structural diagram after a turntable and a chassis in Embodiment 1 are detached.

This specific embodiment is merely an explanation to the present invention, rather than a limitation to the present invention. After reading this specification, a person skilled in the art can make amendments without creative contributions to this embodiment according to requirements, but the amendments are protected by the Patent Law as long as they fall within the protection scope of the present invention. Embodiment 1: a chair reclining adjustment mechanism, as shown in FIG. 1 and FIG. 4, comprises a chassis 2 and a turntable 1; one end of the chassis 2 is provided with a lifting pump 5, and the other end is provided with two side plates 22 to form a U-shaped connection structure; the turntable 1 is connected to a seat of a chair, and is provided with two corresponding side walls 11 between which the two side plates 22 are inserted, and a rotation shaft 3 is used to connect the two side plates 11 and the two side plates 22 to form a rotation structure in a shape of a rocker.

Figure 2:
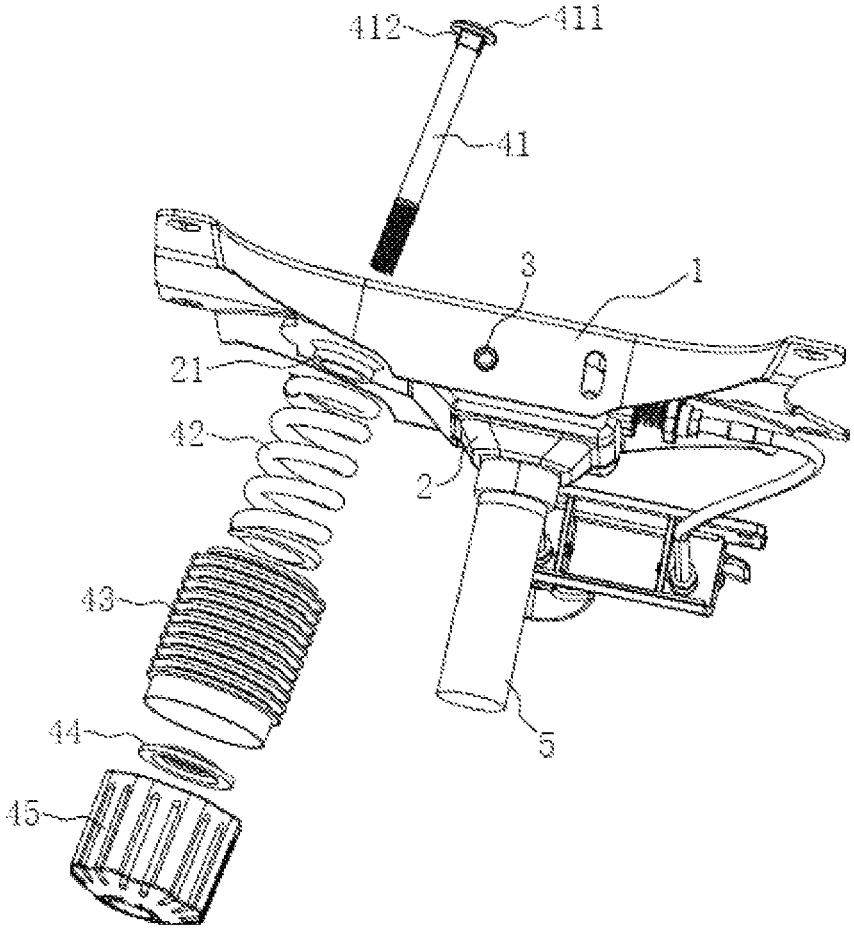
FIG. 2 is schematic structural diagram of Embodiment 1, and shows a structure of an elastic resetting device.
Figure 3:
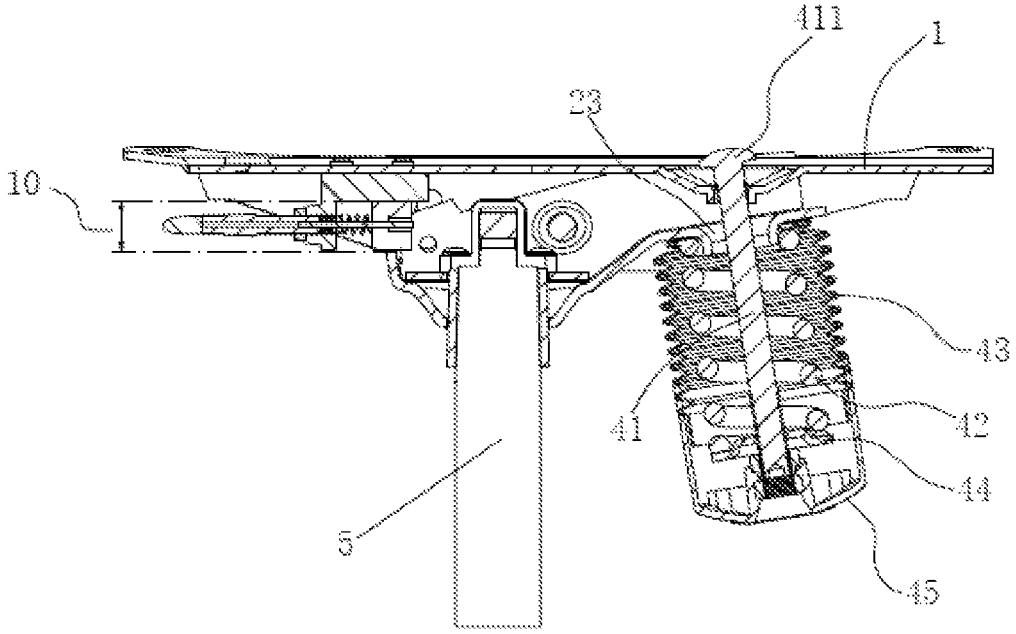
FIG. 3 is a main cross-sectional view of Embodiment 1.

Referring to FIG. 2 and FIG. 3, an elastic resetting device 4 is disposed on the turntable 1 and the chassis 2, and the turntable 1 is pulled and maintained by the elastic resetting device 4 to form a rotation gap 10 on the other side. The elastic resetting device 4 includes a pull rod 41, a compression spring 42, a pressing member 44, and a driving member 45; a connection hole 12 (referring to FIG. 4) is disposed at a position, located on one side of the rotation shaft 3, of the turntable 1, and an escape hole 23 (referring to FIG. 4) is disposed at an edge position, located on one side of the rotation shaft 3, of the chassis 2; one end of the pull rod 41 is provided with a blocking cap 411, and the other end is provided with a thread; the end provided with the thread is in thread connection to the driving member 45 after passing through the connection hole 12, the escape hole 23, the compression spring 42, and the pressing member 44 in sequence. Two ends of the compression spring 42 respectively abut against an end surface of the chassis 2 and the pressing member 44. The driving member 45 is a knob disposed in a hollow manner, the pressing member 44 is accommodated in the knob; a corrugated sheath 43 is sleeved outside the compression spring 42, and one end of the corrugated sheath 43 is inserted in the knob.

Figure 5:
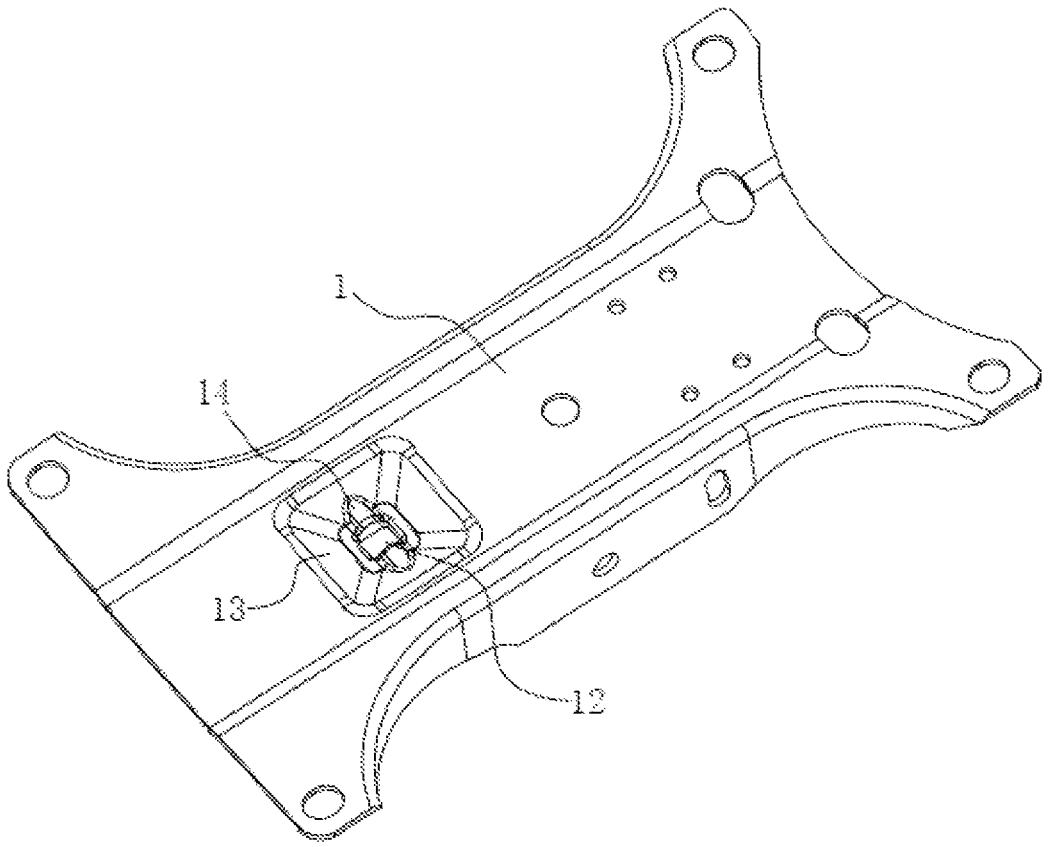
FIG. 5 is schematic structural front view of a turntable in Embodiment 1.
Figure 6:
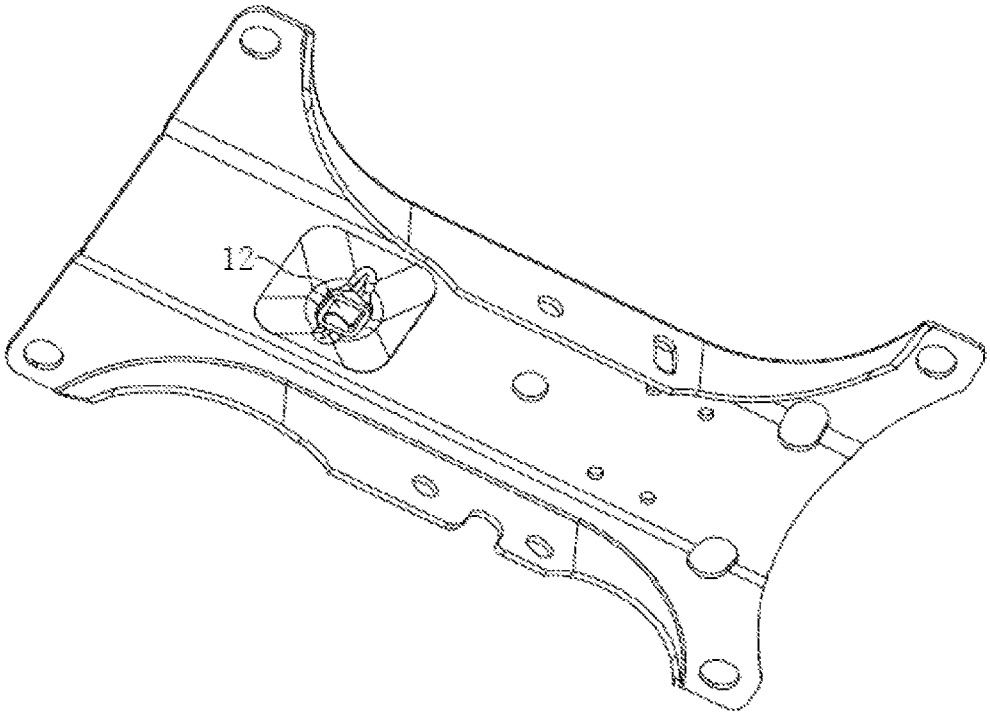
FIG. 6 is schematic structural back view of a turntable in Embodiment 1.

One end, provided with the blocking cap 411, of the pull rod 41 is further provided with a cuboid-shaped limiting block 412, which is connected to the blocking cap 411. Referring to FIG. 5, the connection hole 12 is in a rectangular shape, with a width the same as that of the limiting block 412 and a length greater than that of the limiting block 412, so that the limiting block 412 can be inserted into the connection hole 12 and has a certain moving space. An edge of the connection hole 12 on the turntable 1 is provided with a counterbore 13 recessed towards the direction of the chassis 2, so that the blocking cap 411 has a certain rotation space, thereby avoiding affecting mounting of the seat and the turntable 1; the counterbore 13 is in a shape of an inverted quadrangular frustum pyramid.

Two arc-shaped protrusions 14 are disposed on two sides of the connection hole 12. As shown in FIG. 2, the escape hole 23 may be set to a waist-full form or a circle of which the diameter is greater than the pull rod 41. In this way, when the turntable 1 rotates to drive the pull rod 41 to move, the blocking cap 411 can perform corresponding movement on the arc-shaped protrusion 14, and the escape hole 23 does not limit movement of the pull rod 41.

Referring to FIG. 2, a boss 21 is disposed on an edge of the escape hole 23; the diameter of the boss 21 is less than that of the compression spring 42; radial positioning can be performed on the compression spring 42 by using the boss 21, to avoid cases such as shaking during the use process thereof.

Figure 7:
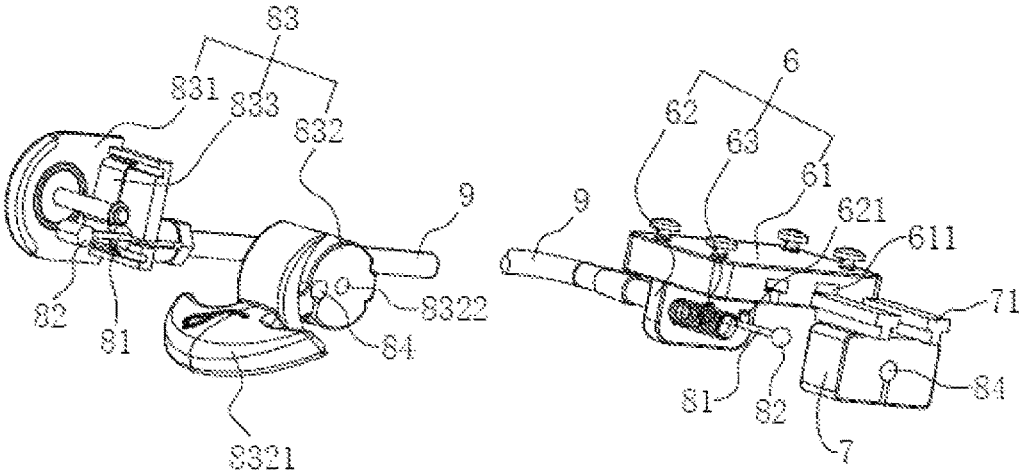
FIG. 7 is a schematic structural view of a locking member and an unlocking component in Embodiment 1.

As shown in FIG. 1, one side, opposite to the side provided with the elastic resetting device 4, of the turntable 1 is connected to a connection block 61 by using a nut; as shown in FIG. 7, the connection block 61 is provided with a T-shaped sliding groove 611; the direction of the sliding groove 611 is set along the length direction of the turntable 1; a slide block 71 is connected to the sliding groove 611 in a sliding and moving manner as a locking member 7; the slide block 71 enters the rotation gap 10 (referring to FIG. 3) to perform rotary limitation on the turntable 1; otherwise, the turntable 1 can rotate under the effect of an external force.

Figure 8:
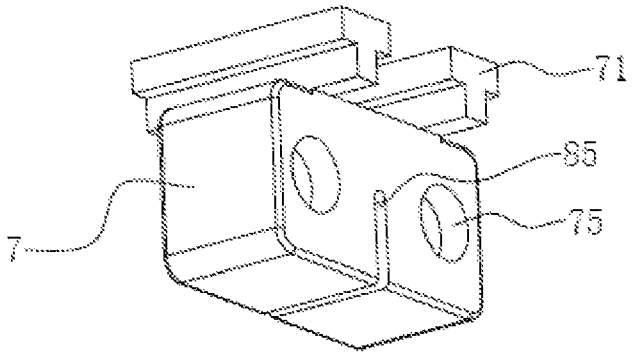
FIG. 8 is schematic structural back view of a slide block in Embodiment 1.

As shown in FIG. 8, two jacks 75 are disposed on the slide block 71; referring to FIG. 7, two limiting protrusions 621 are disposed on the abutting plate 62; a resetting spring 63 is disposed in each of the two jacks 75; an abutting plate 62 vertical to the turntable 1 is disposed on the connection block 61; the abutting plate 62 is disposed on one side, far from the rotation shaft 3, of the slide block 71, and the other end of the resetting spring 63 is sleeved on the limiting protrusion 621 and abuts against the abutting plate 62. The resetting spring 63 and the abutting plate 62 form the locking component 6.

Figure 9:
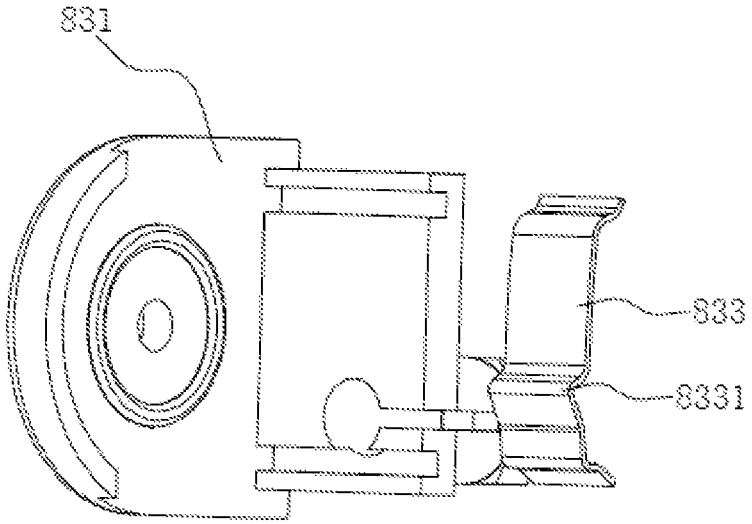
FIG. 9 is a schematic diagram of a structure and mounting structure of a limiting clamping member in Embodiment 1.
Figure 10:
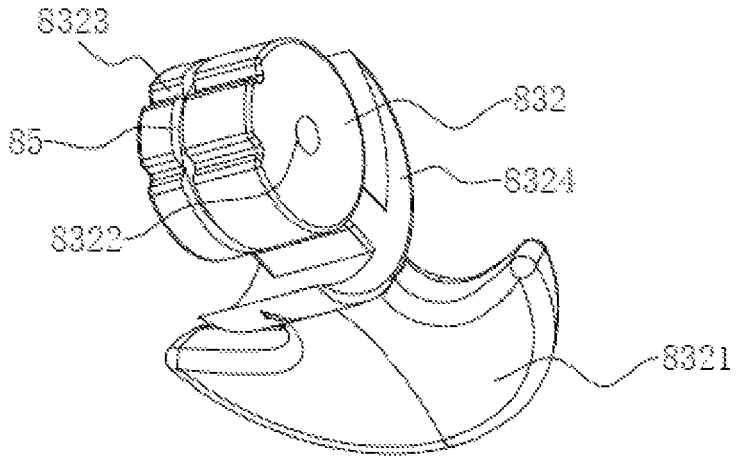
FIG. 10 is schematic structural view of a take-up cylinder in Embodiment 1.

Referring to FIG. 7, the slide block 71 is controlled by an unlocking component 8, which includes a pull string 81, a hollow protection pipe 9, and a retractor 83; as shown in FIG. 9, the retractor 83 includes a housing 831, a take-up cylinder 832, and a limiting clamping member 833; an insertion hole 8322 is disposed in the middle of the take-up cylinder 832; the take-up cylinder 832 penetrates through the insertion hole 8322 by using a rotation shaft to be rotatably connected to the housing 831; as shown in FIG. 10, a clamping slot 84 (referring to FIG. 7) and an accommodating groove 85 configured to accommodate the pull string 81 are disposed on the retractor 83; the accommodating groove 85 is in communication with the clamping slot 84.

Figure 11:
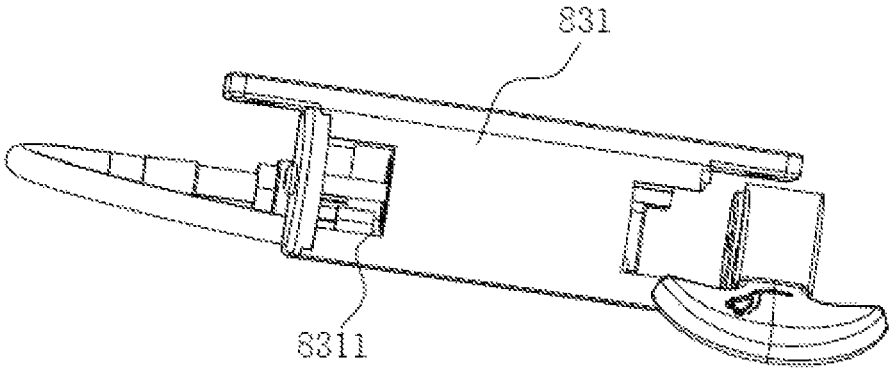
FIG. 11 is a schematic structural diagram of a housing of an unlocking component in Embodiment 1.

One end of the pull string 81 is clamped into the clamping slot 84 by using a clamping member 811 after penetrating through the housing 831, to connect the pull string 81 to the retractor 83. The clamping member 811 on the end is cylindrical. A toggle piece 8321 exposed on the housing 831 is disposed on the take-up cylinder 832 to toggle the take-up cylinder 832 to rotate, so as to accommodate the pull string 81 into the accommodating groove 85. As shown in FIG. 11, an opening 8311 is disposed on the housing 831 to allow toggling of the toggle 8321; the toggle piece 8321 is provided with an arc-shaped baffle 8324 for sealing the opening 8311.

As shown in FIG. 9, the limiting clamping member 833 is an elastic clamping piece that bends to form an clamping protrusion 8331; the elastic clamping piece is clamped on the housing 831; two recessed portions 8323 are disposed on the take-up cylinder 832, into which the clamping protrusion 8331 is clamped to limit rotation of the take-up cylinder 832.

Referring to FIG. 7, a clamping member 811 is also disposed on the other end of the pull string 81. The clamping member 811 on the end is bead-shaped, and the slide block 71 is also provided with a clamping slot 84 and an accommodating groove 85 that is configured to accommodate the pull string 81; the other end of the pull string 81 penetrates through the abutting plate 62 and is clamped into the clamping slot 84 of the slide block 71 by using the clamping member 811 for connection; two ends of the hollow protection pipe 9 are fixedly connected between the abutting plate 62 and the housing 831, and the pull string 81 is inserted in the hollow protection pipe 9.

The turntable 1 is rotatably connected to the chassis 2, and under the effect of the elastic resetting device 4, a person can recline backwards/forwards when sitting on a chair made of the components, so as to drive a seat fixed on the turntable 1 to accordingly rotate, and after an external force disappears, the seat is reset by the elastic force of the compression spring 42 to return to the initial position. In addition, the elastic force of the compression spring 42 can be adjusted by rotating the knob to control the magnitude of the acting force needed to drive the turntable 1 to rotate, and the force can be accordingly adjusted according to requirements of different weights and populations.

In addition, the turntable 1 is limited by means of configuration of the locking member 7, so that whether the chair has a reclining function can be selected according to requirements; at an initial position, a handle is wound on a take-up device, and then the pull string 81 pulls the slide block 71 to keep the compression spring 42 in a compressed state, the slide block 71 is not clamped between the turntable 1 and the chassis 2, and the turntable 1 can drive the seat to rotate. When rotation of the turntable 1 needs to be limited, the take-up cylinder 832 is rotated, so that the pull string 81 becomes longer; under the effect of the compression spring 42, the slide block 71 is pushed towards the rotation shaft 3, so that the slide block 71 is clamped between the turntable 1 and the chassis 2, and in this case, the slide block 71 limits rotation of the turntable 1.

Figure 12:
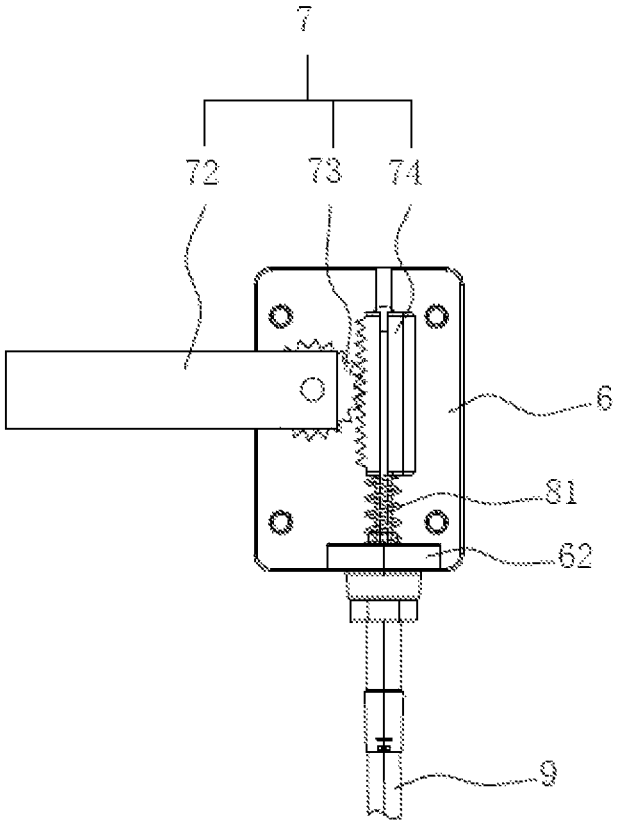
FIG. 12 is a schematic structural diagram of a locking member in Embodiment 2.

Embodiment 2: as shown in FIG. 12, Embodiment 2 differs from Embodiment 1 in that, in this embodiment, the locking member 7 includes a rotation member 72, a gear 73, and a rack 74; the transmission member is rod-shaped; the gear 73 is fixedly disposed on one end of the transmission member, the transmission member is rotatably connected to the turntable 1; the gear 73 is located between the rotation member 72 and the turntable 1. The rack 74 is engaged with the gear 73, and is connected to the connection block 61 in a sliding and moving manner; the sliding and moving direction is a direction of an axial line of the rotation shaft 3. The abutting plate 62 is disposed on a plane vertical to the rotation shaft 3; a jack 75 is disposed on the rack 74 for insertion of the resetting spring 63, and the other end of the resetting spring 63 abuts against the abutting plate 62. The clamping slot 84 and the accommodating groove 85 are disposed on the rack 74, that is, the pull string 81 is connected to the rack 74.

Embodiment 2 differs from Embodiment 1 in that: the pull string 81 and the resetting spring 63 control movement of the rack 74; the gear 73 is driven by the rack 74, and then rotation of the rotation member 72 is driven; when an end portion of the rotation member 72 is rotated between the turntable 1 and the chassis 2, the turntable 1 is limited; when the rotation member 72 is rotated out of a place between the turntable 1 and the chassis 2, limitation on the turntable 1 is removed.

Figure 13:
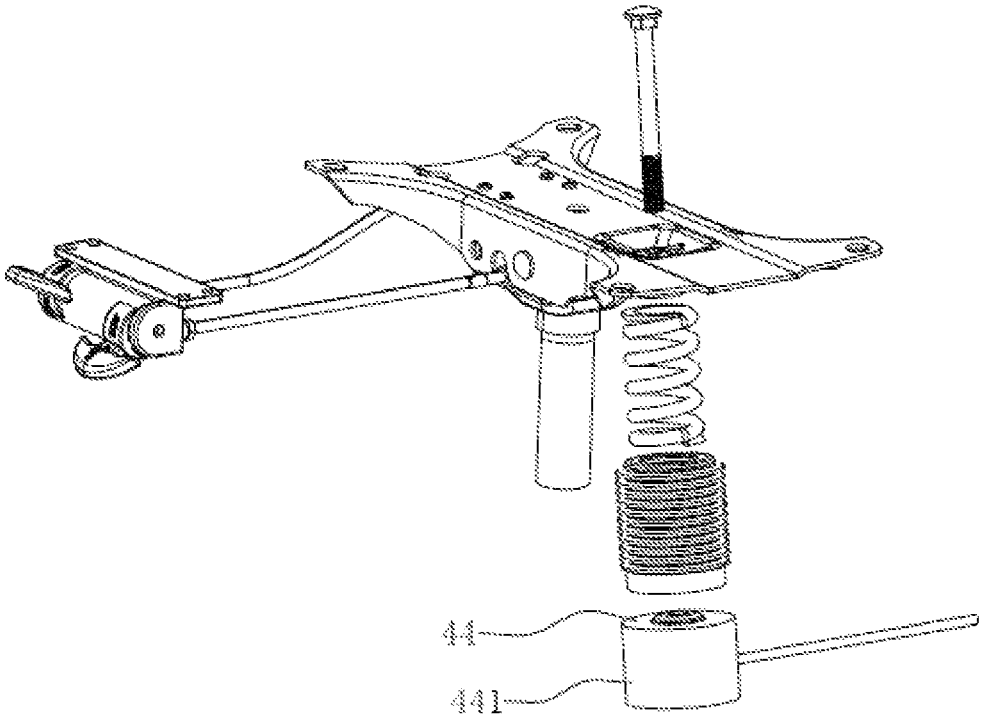
FIG. 13 is an overall schematic structural diagram of Embodiment 3.
Figure 14:
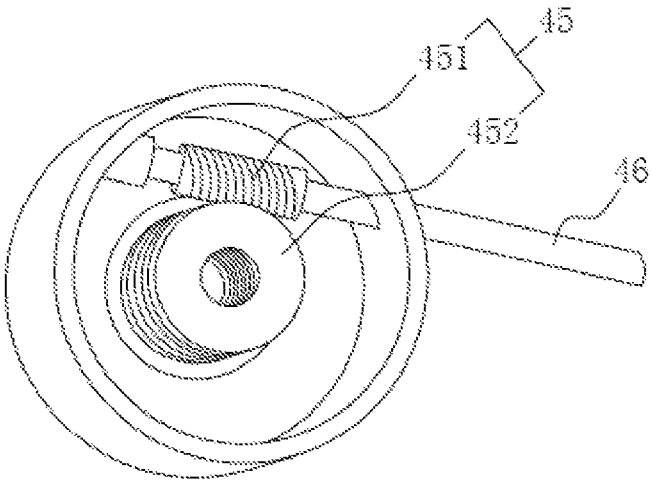
FIG. 14 is a schematic structural diagram of a driving member in Embodiment 3.

Embodiment 3: as shown in FIG. 13 and FIG. 14, Embodiment 3 differs from Embodiment 1 in that: the driving member 45 is a worm and gear mechanism; the pull rod 41 penetrates through one end of the pressing member 44 to be in threaded connection to the worm wheel 452; the pressing member 44 abuts against the worm wheel 452 under the effect of the elastic force of the compression spring 42, and a connection wall 441 is formed downwards to wrap the worm wheel 452; the worm 451 is engaged with the worm wheel 452, and they are fixedly connected to a joystick 461 rotatably connected to the connection wall 441.

Embodiment 3 differs from Embodiment 1 in that a person sitting on a seat can conveniently control the elastic resetting device 4 by means of configuration of the worm 451.

The invention claimed is:

1. A chair reclining adjustment mechanism, comprising a chassis (2), a turntable (1) rotatably connected to the chassis (2) by using a rotation shaft (3), and an elastic resetting device (4) that is disposed between the chassis (2) and the turntable (1) and is configured to always enable the turntable (2) to have a moving trend of rotating towards one side of the rotation shaft (3), wherein a rotation gap (10) is provided between the turntable (1) and the chassis (2) at the other side of the rotation shaft (3); the adjustment mechanism further comprises a locking member (7) capable of entering or slipping out of the rotation gap (10), a locking component that always enables the locking member (7) to have a moving trend of entering the rotation gap (10), and an unlocking component (8) configured to pull the locking member (7) to slip out of the rotation gap (10);

wherein the unlocking component (8) comprises a pull string (81) of which one end is connected to the locking member (7) and a retractor (83) configured to take up a pull string (81) to overcome an elastic force;

wherein the locking component comprises a resetting spring (63) of which an elastic force is opposite to a pull force of the pull string (81) and an abutting plate (62) against which the resetting spring (63) abuts to generate an elastic force; and wherein the locking member (7) comprises a rotation member (72) rotatably connected to the turntable (1), a gear (73) fixedly disposed on the rotation member (72), and a rack (74) engaged with the gear (73) and connected to the pull string (81); an elastic force of the resetting spring (63) acts on the rack (74).

2. The chair reclining adjustment mechanism according to claim 1, wherein the locking member (7) is a slide block (71)

connected to the turntable (1) in a sliding and moving manner, and the elastic force of the resetting spring (63) acts on the slide block (71).

3. The chair reclining adjustment mechanism according to claim 2, wherein each of two ends of the pull string (81) is provided with a clamping member (811); the locking member (7) and the retractor (83) are respectively provided with a clamping slot (84) for embedding the clamping member (811), and an accommodating groove (85) configured to accommodate the pull string (81).

4. The chair reclining adjustment mechanism according to claim 2, wherein the retractor (83) includes a housing (831), a take-up cylinder (832) rotatably connected in the housing (831), and a limiting clamping member (833) that is disposed on the housing (831) and is configured to position the take-up cylinder (832); the clamping slot (84) and the accommodating groove (85) are disposed on the take-up cylinder (832), and a toggle piece (8321) that penetrates through the housing (831) to be connected to the take-up cylinder (832) is disposed outside the housing (831).

5. The chair reclining adjustment mechanism according to claim 4, wherein the limiting clamping member (833) is an elastic clamping piece that bends to form an clamping protrusion (8331), and a plurality of recessed portions (8323) matched with the clamping protrusion (8331) are disposed on the take-up cylinder (832).

6. The chair reclining adjustment mechanism according to claim 1, wherein each of two ends of the pull string (81) is provided with a clamping member (811); the locking member (7) and the retractor (83) are respectively provided with a clamping slot (84) for embedding the clamping member (811), and an accommodating groove (85) configured to accommodate the pull string (81).

7. The chair reclining adjustment mechanism according to claim 1, wherein a hollow protection pipe (9) is disposed between the abutting plate (62) and the retractor (83), and the pull string (81) is inserted into the hollow protection pipe (9).

8. The chair reclining adjustment mechanism according to claim 1, wherein the elastic resetting device (4) comprises a pull rod (41) connected to the chassis (2) and the turntable (1), a compression spring (42) sleeved on the pull rod (41), a pressing member (44) that presses the compression spring (42) on the chassis (2) and a driving member (45) that controls the pressing member (44) to move along an axial direction of the pull rod (41), and the driving member (45) is a knob or a worm and gear mechanism.

* * * * *